United States Patent [19]

Brown et al.

[11] Patent Number: 4,947,743

[45] Date of Patent: Aug. 14, 1990

[54] APPARATUS FOR FEEDING A MASS OF PARTICULATE OR FIBROUS MATERIAL

[75] Inventors: Douglas B. Brown, Oakville, Canada; Henri Malys, Paris, France

[73] Assignee: Stake Technology Limited, Canada

[21] Appl. No.: 312,923

[22] Filed: Feb. 21, 1989

[30] Foreign Application Priority Data

Feb. 19, 1988 [CA] Canada ..... 559312

[51] Int. Cl.[5] ..... B30B 7/00; B30B 15/30; B30B 3/00; B30B 1/26

[52] U.S. Cl. ..... 100/45; 74/603; 100/90; 100/93 S; 100/127; 100/137; 100/145; 100/148; 100/191; 100/292; 100/904; 100/906

[58] Field of Search ..... 100/93 S, 117, 145–150, 100/191, 192, 137–139, 904, 906, 909, 37, 90, 91, 282, 292, 99, 126, 127, 116, 110, 45; 74/603, 604, 49

[56] References Cited

U.S. PATENT DOCUMENTS

| | | | |
|---|---|---|---|
| 3,991,681 | 11/1976 | Antosiak | 100/292 X |
| 4,119,025 | 10/1978 | Brown et al. | 100/35 |
| 4,186,658 | 2/1980 | Brown | 100/148 |
| 4,211,163 | 7/1980 | Brown et al. | 100/145 |
| 4,289,410 | 9/1981 | Anders | 366/88 |
| 4,386,512 | 6/1983 | Rehag et al. | 74/603 X |
| 4,412,485 | 11/1983 | Brown | 100/117 |
| 4,630,516 | 12/1986 | Koch et al. | 74/603 X |

FOREIGN PATENT DOCUMENTS

| | | | |
|---|---|---|---|
| 617721 | 2/1927 | France . | |
| WO84/01125 | 3/1984 | PCT Int'l Appl. | 100/117 |
| WO84/01606 | 4/1984 | PCT Int'l Appl. | 74/603 |
| 576090 | 10/1977 | U.S.S.R. | 100/117 |
| 1170315 | 11/1969 | United Kingdom | 100/192 |
| 1506455 | 4/1978 | United Kingdom . | |
| 1528052 | 10/1978 | United Kingdom . | |

*Primary Examiner*—Harvey C. Hornsby
*Assistant Examiner*—Stephen F. Gerrity
*Attorney, Agent, or Firm*—Stevens, Davis, Miller & Mosher

[57] ABSTRACT

Apparatus for compacting and advancing a mass of particulate or fibrous material to a discharge end of a conduit combines an auger with a reciprocating annular piston. The improvement of the invention is in driving the piston by way of a flywheel equipped crankshaft which also drives a dynamically counter balancing member to reduce vibrations transmitted to the frame of the apparatus. Special hydrostatic guide sleeves are used to guide the reciprocating piston at a high speed. Further improvements include gas and liquid vents and a cooling jacket, both associated with the conduit to increase efficiency of the compacting. A density sensor controlled conical choke member at the discharge end assists in maintaining uniform density of the highly compacted plug of the material. Also, it breaks up the exiting plug to improve subsequent processing of the material. The uniformity of the compacting is assisted by a modified shape of the leading face of the piston which is flat at the outer periphery and frusto conical near the minor diameter of the piston. The conduit preferably tapers at about 7′ to 21′ toward its discharge end.

16 Claims, 6 Drawing Sheets

APPARATUS FOR FEEDING A MASS OF PARTICULATE OR FIBROUS MATERIAL

BACKGROUND OF THE INVENTION

The present invention relates to apparatus for feeding a mass of particulate and/or fibrous material of the type which includes a conduit communicating with screw conveyor means, reciprocating annular piston means coaxial with and partly surrounding the screw conveyor means, first drive means operatively associated with the screw conveyor means and second drive means operatively associated With the annular piston means for reciprocating the piston coaxially with the axis of the screw conveyor means.

DESCRIPTION OF THE RELATED ART

The device of the above type is known from U.S. Pat. No. 4,186,658 issued Feb. 5, 1980 and assigned to the present applicant. The device of the above U.S. patent presented a substantial breakthrough in the art of feeding particulate or fibrous material into devices such as pressurized digesters in that fibrous material of relatively low fibre shear strength could be compacted to an extremely high compactness to form a virtually solid plug through which the pressurized medium from the processing stage located downstream of the compacting apparatus could not penetrate.

Reference may be also had to our U.S. Pat. No. 4,119,025 issued Oct. 10, 1978 for the method of operating the device and to our U.S. Pat. No. 4,412,485 issued Nov. 1, 1983, showing the use of the arrangement for the purpose of dewatering a fibrous or the like mass.

In general terms, the previous device as set forth above has an annular piston which surrounds an auger disposed within a conduit. The auger is operatively associated with a hopper into which the fibrous material (for instance wood chips) is loaded. The auger feeds the material to its discharge end and from then on the further advancement of the mass is caused by the reciprocating annular piston which allows the movement of a highly compacted mass through the conduit into the processing stage, for instance, into a digester.

The invention protected by the above U.S. patents presented a significant advance in the art which was achieved by combining the annular shape of a reciprocating piston with the action of a regular screw conveyor.

Due to the high density achieved by the compacting of the fibrous material by the annular piston, certain components of our previous device experienced excessively high wear rates resulting in premature wear. Furthermore, the high density of compaction of the material resulted in substantial impact loads and consequentially high vibrations to the overall device, regardless of whether the piston was driven by hydraulic cylinders such as disclosed in our U.S. Pat. No. 4,186,658, or one utilized a crank device as shown in our U.S. Pat. No. 4,412,485.

The high impact loads may result in fatigue failures of feeder components and premature bearing failure. The vibrations of the overall device are undesirable as they have serious consequences particularly at the discharge end of the device, if it is attempted to maintain the density of the compacted plug of the material within the conduit at a highly uniform value. The vibrations caused by the high impact were one of the reasons why the speeds of the devices of this type thus far in operation were relatively slow.

Accordingly, it is an object of the present invention to improve the known device by increasing the overall mechanical and energy efficiency thereof. It is also an object of the present invention to improve the uniformity of the density of the compact plug of the material formed by the device. Another purpose of the invention is to facilitate further processing of the mass contained in the plug by breaking the plug up at the discharge end of the device to more readily expose the discharged material to a subsequent treatment, for instance by steam, chemicals or the like, While retaining the shape of the plug still within the conduit in a solid state, impermeable by liquid and vapour.

SUMMARY OF THE INVENTION

In general terms, the invention provides apparatus for feeding a mass of material comprised of solid particles or fibres and including a conduit within which is disposed screw conveyor means, reciprocating annular piston means coaxial with and partly surrounding the screw conveyor means, first drive means operatively associated with the screw conveyor means, and second drive means operatively associated with the annular piston means for reciprocating same coaxially with the axis of the screw conveyor means. In accordance with the improvement of the present invention, the second drive means includes a motor driven transverse crankshaft operatively associated with a flywheel; the device further comprises first connecting rod means operatively connecting the crankshaft with a reciprocating support mounted for a linear, reciprocating movement in a direction parallel with the axis of the screw conveyor means; mounting means fixedly securing the piston means to said reciprocating support; second connecting rod means operatively connecting said crankshaft with a counter balance support movable relative to the axis of the crankshaft in opposed sense to the movement of the reciprocating support to at least partly counterbalance vibrations generated by the reciprocating support.

According to another feature of the invention, the reciprocating support is provided with a pair of elongated cylindric guide members parallel with each other and with the axis of the screw conveyor means. The guide members are arranged one to each side of the conduit and each guide member is slidably received in a pair of slide bearings, preferably of the type of hydrostatic slide bearings, preferably having their axes within the same horizontal plane as the plane of the axis of the conduit. The crankshaft axis is also preferably disposed within the same horizontal plane.

In a preferred embodiment, the dynamical counterbalance support is of the type of an inverted pendulum connected by a connecting rod mechanism to the crankshaft and reciprocating in a direction opposite to the instant motion of the reciprocating support of the annular piston.

The efficiency of the device as far as compacting is concerned is further improved by providing the downstream end of the conduit with a choke member which is of a conical shape convergent in an upstream direction and coaxial with the conduit The choke member is selectively displaceable axially to control cross-sectional area of an annular space between the surface of the conical choke member and the downstream end of the conduit. The controlling of the motor displacing the choke is carried out by a density sensor, in the shown embodiment, a Gamma ray sensor.

The compacting operation at a high speed, is allowed by the counterbalancing of the reciprocating mass of the piston and its support The effectiveness of the compacting is further assisted by venting the gases and liquids from the conduit in which the piston reciprocates The gases and liquids pass through longitudinally arranged slots in the wall of the conduit.

The uniformity and the degree of compactness of the mass is improved substantially if a portion downstream of the reciprocating piston but upstream of the discharge end including the density sensor is cooled to remove the heat coming from the digester.

The invention will be described in greater detail with reference to the accompanying drawings wherein:

DESCRIPTION OF THE PREFERRED EMBODIMENTS

Figure 1:
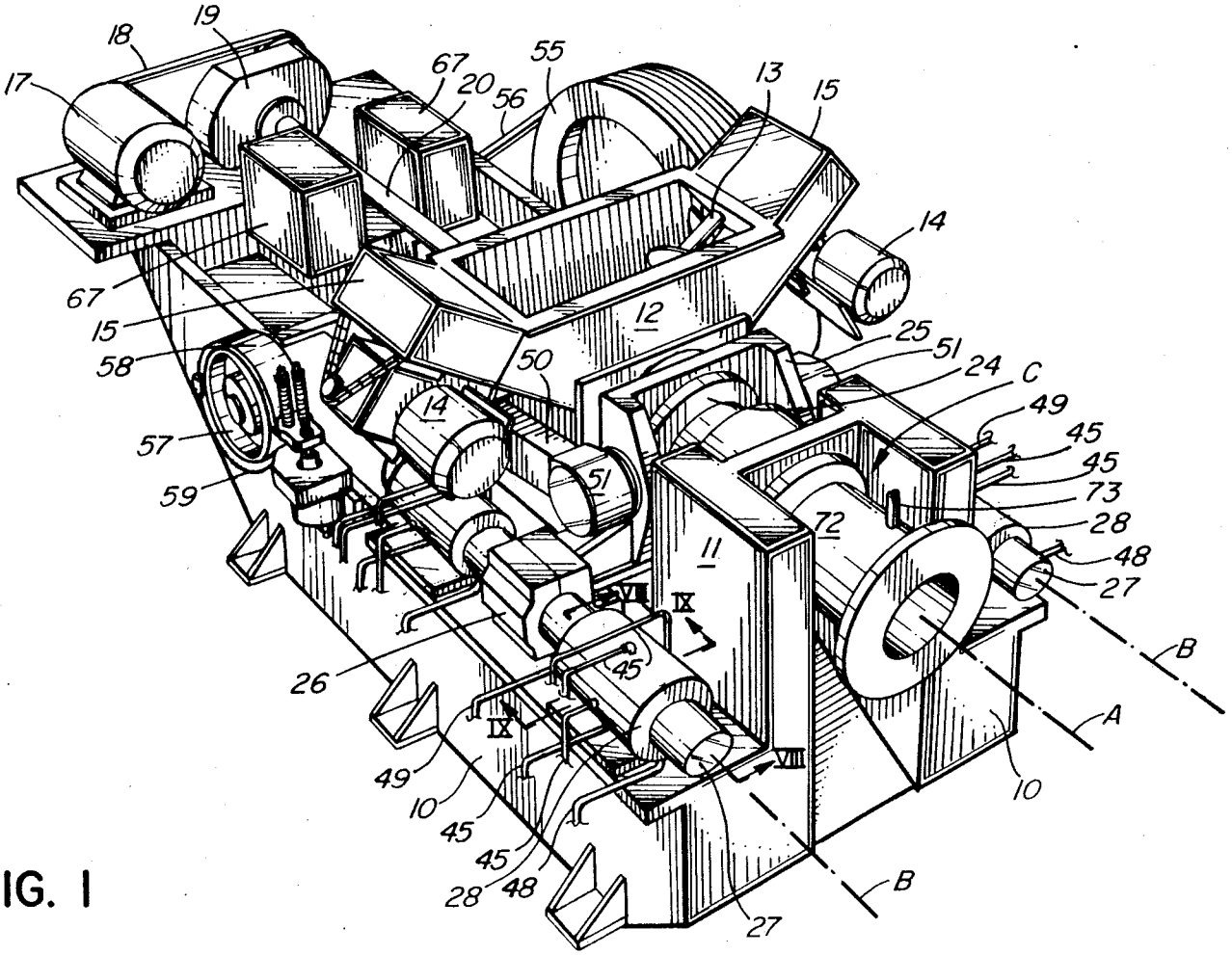
FIG. 1 is a simplified perspective view showing a substantial part of one embodiment of a device of the present invention, with certain elements at the discharge end not shown.
Figure 2:
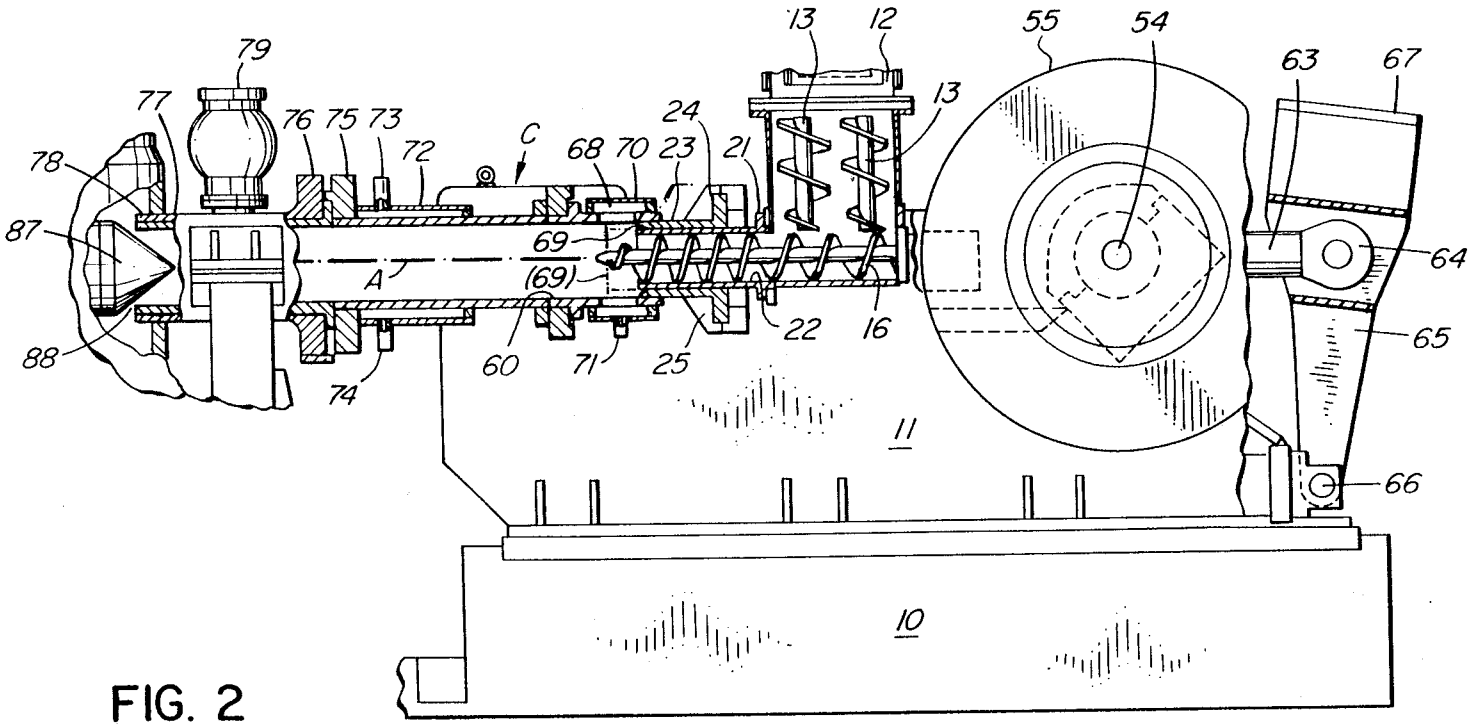
FIG. 2 is a simplified side view, partly in section, of a modified embodiment of the device.
Figure 3:
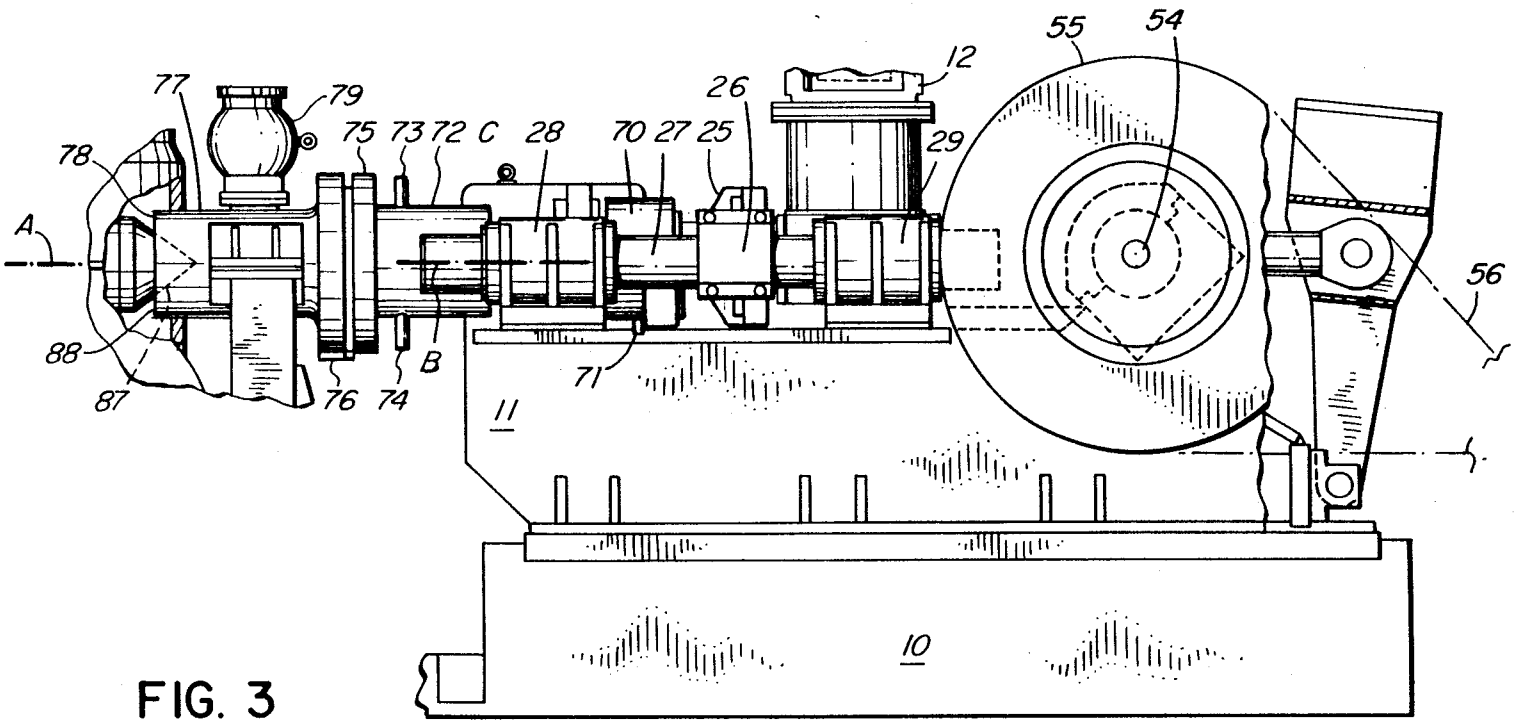
FIG. 3 is a simplified side view similar to that of FIG. 2 but showing certain parts which are not visible in the cross sectional view of FIG. 3.
Figure 4:
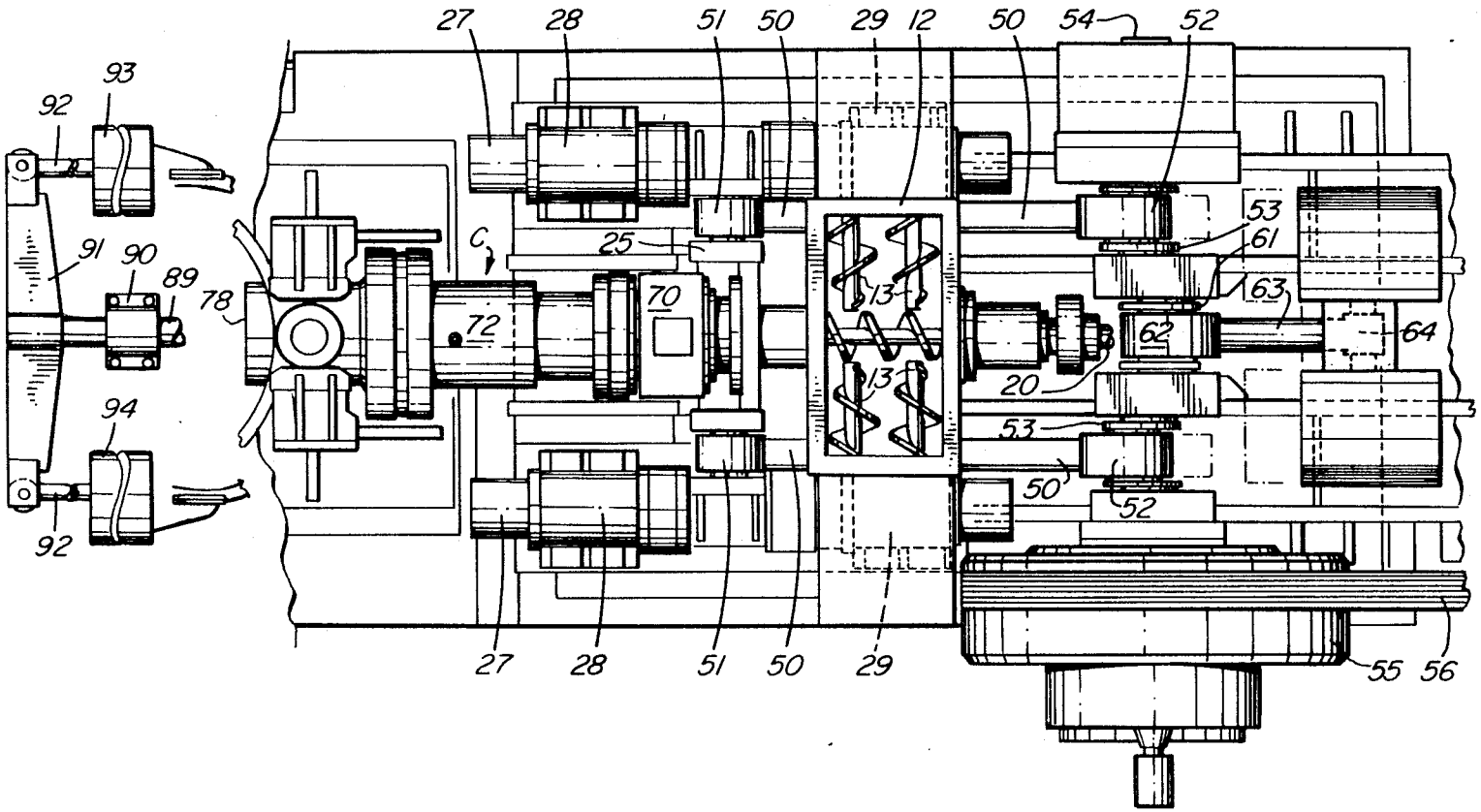
FIG. 4 is a simplified top plan view of the device shown in FIGS. 2 or 3.

While the device shown in FIG. 1 differs from that of FIGS. 2, 3 and 4 in certain details, the overall arrangement is very similar and the corresponding parts are therefore referred to with the same reference numerals.

The base 10 which is anchored to the ground in the known way carries on its top a frame 11 (not particularly designated in FIG. 1). The frame 11 carries a horizontally disposed tubular conduit generally referred to with the letter C. The discharge end of the conduit C is at the left of FIGS. 2 and 3 and at the front right of FIG. 1. The opposed inlet end of the conduit C is provided with a hopper 12 which includes a system of downwardly and inwardly directed augers 13 driven by motors 14 shown only in FIG. 1, over respective drive units 15 The arrangement of the hopper 12, augers 13 and of the drive units 15 is well known in the art and does not have to be described in greater detail.

The lower ends of the four augers 13 (two on each side of the sloped portions of the hopper 12) are disposed near the periphery of a horizontally arranged conveyor screw 16 which is driven by a motor 17, via a belt 18, gear box 19 and a drive shaft 20.

Referring to FIG. 2, the screw conveyor 16 is rotatably mounted in the right-hand portion of the wall of the hopper 12. Fixedly secured to the opposed forward wall portion of the hopper 12 is a flange 21 of a tubular guide member 22 which receives the front part of the screw 16. Thus, the screw 16 is rotatable .at its upstream or rear end in a bearing (not shown) secured to the wall of the hopper 12 while the front, free end of the conveyor screw 16 is guided in the stationary tubular guide member 22.

The annular piston 23 slides freely over the outer surface of the tubular guide member 22. It is provided, at its upstream (right) end, with a mounting flange 24 which secures the piston 23 to a reciprocating support 25. At each side of the reciprocating support 25 is provided a mounting sleeve 26 which is generally of the type of a split cylinder firmly clamped to a cylindric guide rod 27. Each guide rod 27 is mounted in a front hydrostatic bearing 28 and in a coaxial rear hydrostatic bearing 29.

Figure 8:
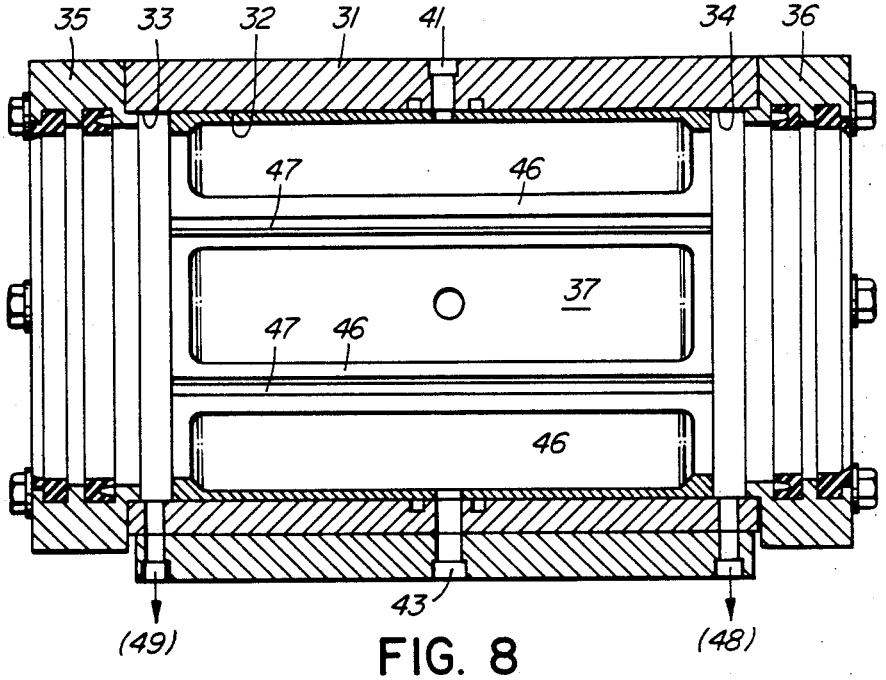
FIG. 8 is section VIII—VIII of FIG. 1.
Figure 9:
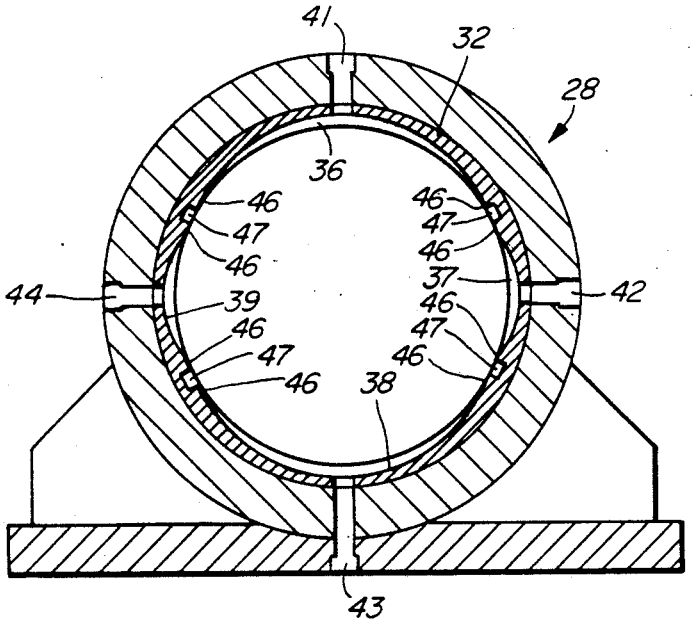
FIG. 9 is section IX—IX of FIG. 1.

Reference may now be had to the representation of FIGS. 8 and 9, showing a typical arrangement of the hydrostatic bearings, by way of describing the bearing 28.

The bearing 28 is comprised of a housing 31 with a sleeve 32 made of a bronze alloy. The sleeve 32 is shorter than the overall axial length of the inside cylindric wall of the housing 31, so that an annual collection chamber 33, 34 is formed at each end of the sleeve. A seal holding flange 35, 36 closes the outside end of each collection chamber 33, 34. Each flange 35, 36 has a pair of seals engaging the guide rod 27, as is well known in the art.

The inside surface of the sleeve 32 is provided with four pockets 36, 37, 38, 39. Each pocket is associated with an inlet port 41, 42, 43, 44 for pressurized oil supplied by a respective line 45.

There is a longitudinal land 46 between each pair of adjacent pockets 36–39. Each land is provided with a longitudinal trough 47 providing a conduit communicating the collection chambers 33, 34 with each other. Each collection chamber, in turn, is provided with a return port communicating with a return line 48, 49 of a lubricant circuit system which includes a reservoir and a pump associated with the pressure oil lines 45 (the reservoir and the pump not shown in the drawings).

As is known, the pockets 36, 37, 38, and 39 are supplied with pressurized oil and thus provide frictionless cushions for firm and accurate sliding of the respective guide rod 27. The lubricant that passes between the rod 27 and the lands 46 near the pockets 36–39, is eventually collected in one of the chambers 33, 34 and returned back into the pressurized part of the lubricant circulation.

It is one of the differences between the embodiment of FIG. 1 and that of FIGS. 2 and 3 that the guide rods 27 in FIG. 1 are so disposed with respect to the axis A of the conduit that the axes B are located at a level lower than the level of the axis A. In other words, the axes A, B, B define a triangle in an end view. According to one feature of the present invention, shown in FIG. 3, the guide rods 27 are raised to the level of axis A. In other words, the axes A, B, B are then coplanar, preferably in a horizontal reference plane as shown in the drawings.

A connecting rod 50 is pivotably secured at its front end 51 to the reciprocating support 25 and at its rear end 52 to the respective one of coaxial cranks 53 of a crankshaft 54. The crankshaft 54 is mounted for rotation in the support 11 about a transverse horizontal axis which, in the embodiments of FIGS. 2 and 3, is coplanar with the horizontal plane of axes A, B, B.

The crankshaft 54 is provided with a flywheel 55 secured to the end of the crankshaft 54 and associated with a drive belt system 56. The opposite end of the crankshaft 54 is provided with a brake drum 57 provided with a pair of brake clamps 58, 59.

There are two connecting rods 50 as described above and two corresponding cranks 53 of the crankshaft 54. The connecting rods 50, disposed one to each side of the reciprocating support 25, translate the rotation of the crankshaft 54 to the reciprocating motion of the support 25 and thus of the piston 23 within the conduit C. Due to the strong and accurate mounting of the guide rods 27 in bearings 28, 29, the annular piston 23 moves over the tubular guide member 22 and in a central section 60 of the conduit at a substantially reduced friction thus reducing wear.

At the center of the crankshaft 54 is disposed a central crank 61 to which is rotatably secured the front end 62 of a central connecting rod 63 whose rear end 64 is pivotably secured to an inverted pendulum-like counterbalance support 65 which is pivoted in support 11 at a pivot 66. The upper, free end of the counter balance support 65 is provided with weights 67 on each side. The weights 67 are thus disposed one to each side of the axis A of the conduit.

It can be seen on review of FIG. 4 that the central crank 61 of the crankshaft 54 is disposed at 180° with respect to the coaxial cranks 53. Accordingly, the rotation of the crankshaft 54 at any given time results in movement of the piston 23 in opposed direction to the movement of the weights 67.

The rear end of the central conduit section 60 of the conduit C is provided with vent slots 68 which extend longitudinally over a substantial part of the length of the stroke of the face 69 of the piston 23. The extreme positions of the face 69 are shown in FIG. 2. The rearmost extreme position is that of full lines of piston 23 while the forwardmost position is shown in broken lines and designated with the reference numeral 69 in parentheses.

The slotted area of the central conduit section 60 is provided with a jacket 70 which communicates with the surrounding atmosphere and/or with sewage (to remove any liquid that may escape with the gas) through a port 71. The coaxial lengths forming the central section 60 of the conduit C are held together by a flange arrangement, as is well known in the art.

The left-hand part of the central section 60 is provided with a cooling jacket 72 which has a cooling water inlet 73 and a cooling water outlet 74.

Another flange 75 cooperates with a connecting flange 76 of an end member 77 of tubular configuration, provided with an end tube 78 the inside of which form a cylindric continuation of the central section 60. The end member 77 is provided with a gamma ray density control device 79. The device measures the density of the mass in the tube 78 It is of a commercially available type.

Figure 5:
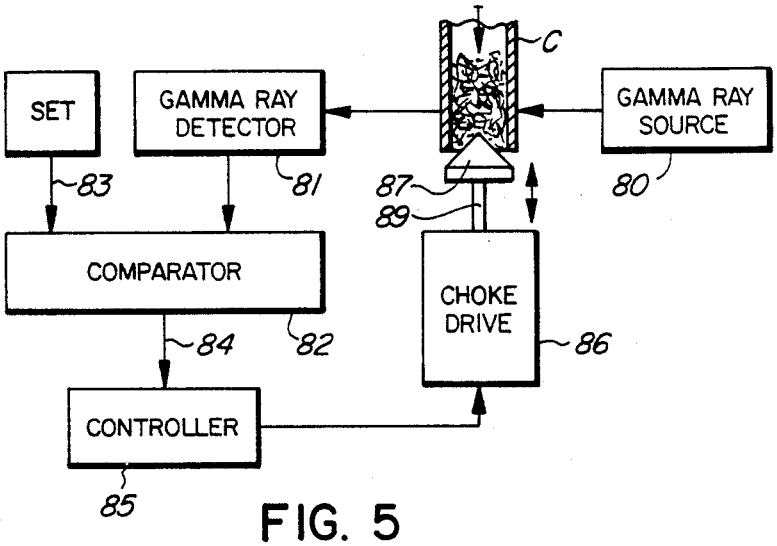
FIG. 5 is an operational block diagram of the choke member of the discharge end.

In a prototype of the feeding device of the present invention, the density control device was a Kay-Ray Model 4800 TM Single Point System, the operation of which is apparent from the diagram of FIG. 5. The physical structure includes a gamma radiation source 80, in the used device, a Cesium 137 source. The source material is doubly encapsulated in stainless steel and is located in the centre of a lead-filled steel holder which is disposed to one side of the conduit C. Disposed at a transversely opposite side of the conduit C is the gamma radiation detector 81, of the type of, a Geiger-Mueller tube detector Incident radiation generates an electrical discharge at a rate proportional to the radiation intensity. The radiation intensity depends on the density of the material within the conduit C. It is at its maximum when the conduit C is empty. It gradually decreases as the material within the conduit becomes compacted to form a plug. The electrical discharge of the detector 81 is fed to a comparator 82 which compares the actual discharge with a set discharge 83 and generates a signal 84 for a controller 85 to actuate the drive 86 of the choke as described hereinafter.

In the prototype, the drive 86 was comprised of a pair of hydraulic cylinders associated with a conical choke member 87 to displace same along the axis A from a minimum gap state shown in FIG. 2 to a gap state depicted in FIG. 3. It has been found to be of advantage to substitute the hydraulic cylinders with pneumatic cylinders as the latter have better energy absorbing characteristics.

It can be seen from FIGS. 2 and 3 that the choke member 87 is of a solid, conical configuration convergent in the direction toward the upstream end of the conduit and coaxial with axis A. As mentioned above, the choke member 87 defines, with the outlet of the end tube 78, the discharge gap or passage 88 of annular cross sectional configuration.

The hydraulic mechanism of the plug member 87 is of generally the same configuration as shown, for instance, in our U.S. Pat. No. 4,412,485 in connection with a dewatering plug member. The downstream end of the choke member 87 is provided with a cylindric stem 89 slidable in a sleeve 90. The downstream end of the sleeve 90 is provided with a transverse member 91. Each end of the member 91 is connected with a piston rod 92 of a respective hydraulic cylinder 93, 94. The hydraulic cylinders 93, 94, in turn, are each fixed to a frame member integral with the support 11, either directly or through a suitable connecting element.

Figure 6:
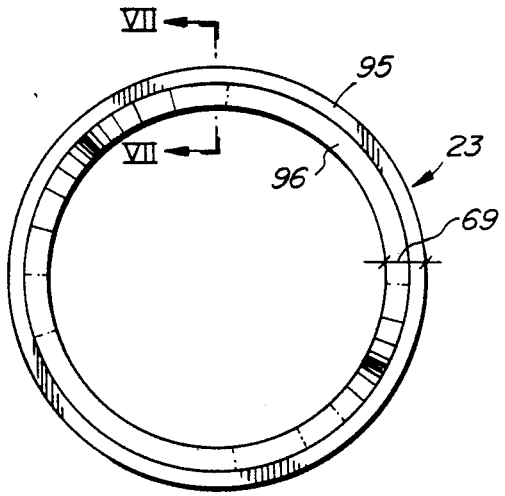
FIG. 6 is an end view of a modified embodiment of the face of the piston.
Figure 7:
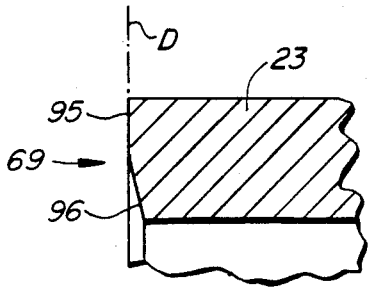
FIG. 7 is section VII—VII of FIG. 6.

The object of improving the uniformity of the density of the plug of compacted material is also assisted by a modification shown only in FIGS. 6 and 7. In the preferred embodiment of the modification shown, the frontal face 69 of the piston 23 is comprised of an outer section 95 and an inner section 96.

The outer section 95 is flat and is disposed in a transverse plane D perpendicular to the axis of the piston 23 which, in the shown embodiment, is the axis A. The inner section 96 is frustoconical at an apex angle of about 155°. The apex angle can be from about 140° to about 170°.

When viewing the piston from an end view, the two sections 95, 96 appear as two concentric annular figures. The area of the outer annular figure 96 is about 30% of the combined area of the two annular figures 95, 96, while the area of the angled section 96 is about 70% thereof. The area of the outer annular figure 95 may vary within about 25 to about 35% of the overall area of the face 69.

The total area of the frontal face 69 in the end view, presents about 35% of the overall cross-sectional area of the conduit C. The combined area may vary between about 25 to about 60% of the overall cross-sectional area of the conduit C.

It has been established that the modified configuration of the face 69 results in a more uniform density of the plug. This is due to an improved compactness of the centre of the plug, which is important when using the device to feed a digester. The improved compactness at the centre of the plug substantially reduces the possibility of blow backs and hence loss of digester pressure.

The modified shape of the face 69 also results in a more economical use of energy.

In operation, and referring firstly to the representation of FIG. 5, the gamma ray density control device is set to the desired density of the compacted mass at the discharge end of the conduit. With the gamma ray source activated, the gamma ray counter transmits information of the absence of the treated material within the conduit to a comparator which, in turn, induces the controller to actuate the choke drive to bring the gap 57 to a minimum (FIG. 2). The processed material, for instance wood chips, is then fed through the hopper 12 and is assisted by the augers 13 to reach the area of the horizontal screw conveyor 16 which delivers the material downstream into the conduit C The crankshaft 54 is driven by a motor (not shown), via the belt 56. At the same time, a pump (not shown in the drawings) is actuated to deliver pressurized lubricant to the hydrostatic bearings 28, 29. The rotary motion of the crankshaft 54 is transmitted by the connecting rods 50 to the reciprocating support 25 and thus to the annular piston 23. At the same time, the connecting rod 63 transmits the rotary motion of the crankshaft 54 to the counterbalance support 65 to swing same back and forth in a direction counter to that of the instant movement of the piston.

The material supplied through the hopper 21 eventually fills the space of the central section 60 and becomes compacted by the annular piston as is well known from prior art referred to above. This results in a gradual formation of a compressed, compact plug advancing within the conduit C. The formation is assisted by maintaining atmospheric pressure at the inlet part of the central section 60, due to the arrangement of the vent slots 68, the jacket 70 and the discharge port 71 removing gases, usually with some liquid from the compacted mass.

At the same time, cooling water is circulated through the jacket 72. It enters at the cooling water inlet 73 and is discharged through the cooling water outlet 74.

Eventually, the compactness of the material surpasses the value set for the gamma ray counter (FIG. 5). The comparator of the control circuit then induces the controller to actuate the choke drive to a more open position. As the gamma ray counter continues to sense the instant density, the degree of opening of the choke 87 is constantly monitored and modified to prevent the reduction of the desired density of the compacted plug beyond a pre-set minimum.

Due to the arrangement of the hydrostatic bearings, the piston is firmly guided along the axis at the conduit. Also, despite the massive mounting, the device is capable of operating at a high speed, very substantially higher than that of the known devices. The device of the present invention has been successfully run at speeds of about 400 cycles per minute which compares very favourably with the maximum of 60 cycles per minute achieved with the known devices of this type. The high speed is also made possible by counter balancing the vibrations inevitably generated on impact of the annular piston against the compacted mass within the conduit. Since the counter balance support 65 provides a dynamic force active against the reaction of the compacting force, the vibrations experienced in the devices of prior art have been removed to a substantial degree. Removal of such vibrations also favourably influences the accuracy of the operation of the choke member 87 and its associated parts including the gamma ray sensor all of which are relatively sensitive to vibrations.

It was also discovered that the compacting is more reliable if the heat, coming mainly from the digester, is removed by cooling a portion of the conduit downstream of the reciprocating piston and upstream of the discharge end of the conduit. This is important from the standpoint of preventing thermal expansion of the piston assembly and hence metal on metal contact. Another advantage is in that the thermal expansion load of the central section and of the conduit in general is minimized.

The compacting is also assisted by a very slight taper of the conduit C in the direction towards the discharge end. The taper of the conduit may be within the range of about 7′ to about 21′, i.e. substantially less than 1°.

Finally, the discharged compacted material is attacked at the very end of the conduit by the choke 87 the tip of which breaks up only the leading part of the compact plug. The breaking up of the plug has beneficial effects in further processing, for instance in a digester or in other processing devices operatively associated with the feeder. By the same token, the compactness at the adjacent gamma ray sensor is undisturbed. Thus, the device provides, on the one hand, an improved exposure of the material within the subsequent processing device while maintaining a high compactness of the plug immediately upstream of the discharge end, to keep the plug solid to safely isolate the pressurized chemicals in a digester or the like downstream of the feeder from the mechanism of the feeder itself.

Those skilled in the art will readily appreciate that there may be many modifications falling within the scope of the present invention while being different from the described preferred embodiment. As an example only, the mounting of the counterbalance can be modified to a sliding arrangement. This and many other modifications of the preferred embodiment, however, fall within the scope of the invention.

Accordingly, we wish to protect by the Letters Patent which may issue on the present application all such embodiments which properly fall within the scope of our contribution to the art.

We claim:

1. Apparatus for feeding a mass of material comprised of solid particles and/or fibres, including a conduit provided with screw conveyor means, reciprocating annular piston means coaxial with and disposed in said conduit and around the screw conveyor means, first drive means for driving said screw conveyor means, and second drive means for driving the annular piston means in reciprocating fashion coaxially with the axis of the screw conveyor means, wherein said second drive means includes:

(a) a motor driven, transverse crankshaft operatively associated with a fly wheel;

(b) first connecting rod pivotably secured at one end thereof to the crankshaft, and at the other end thereof to a reciprocating support mounted for a linear, reciprocating movement in a direction parallel with the axis of the screw conveyor means;

(c) mounting means fixedly securing the piston means to said reciprocating support;

(d) a second connecting rod operatively connecting said crankshaft with a counterbalance support movable relative the axis of the crankshaft in opposed sense to the movement of said reciprocating support to counter balance vibrations generated by the reciprocating support.

2. Apparatus as claimed in claim 1, wherein said reciprocating support is provided with a pair of elongated cylindric guide members parallel with each other and with the axis of the screw conveyor means, the guide members being arranged exteriorly of and at opposed sides of said conduit, each guide member being slidably received in a pair of slide bearings disposed one near each end of the respective guide member.

3. Apparatus as claimed in claim 2, wherein each slide bearing is a hydrostatic slide bearing in which the respective guide member is supported virtually entirely by a lubricating fluid contained in a series of pockets formed at an interior of the bearing, said pockets communicating with pressure inducing means adapted to maintain the fluid in the pockets at a predetermined pressure.

4. Apparatus as claimed in claim 2, wherein the axes of the guide members and the axis of the conduit are generally coplanar.

5. Apparatus as claimed in claim 4, wherein the plane in which the axes of the guide members and the axis of the conduit are disposed in a common, generally horizontal reference plane.

6. Apparatus as claimed in claim 5, wherein the axis of rotation of the crankshaft is in said horizontal reference plane.

7. Apparatus as claimed in claim 1, wherein said counter balance support is an inverted pendulum-like counterbalance support pivotable about a swing axis parallel with the axis of the crankshaft and provided with weight means disposed near an upper, free end of the counterbalance support, one end of said second connecting rod means being pivotably secured to said counterbalance support at a pivot point disposed between said free end and said swing axis.

8. Apparatus as claimed in claim 7, wherein the counterbalance support is so arranged and disposed that said pivot point is coincident with or closely spaced from said horizontal reference plane.

9. Apparatus as claimed in claim 1, wherein the area of a frontal face portion of the piston means when viewed in an end view, is about 25% to about 60% of the entire inside cross-sectional area of the conduit, said frontal face portion comprising a frustoconical angled surface coaxial with the axis of the piston means, convergent in a direction upstream of the conduit and having an apex angle of about 140° to about 170°.

10. Apparatus as claimed in claim 9, wherein the frustoconical angled surface is an inner frustoconical angled section, said frontal face portion further comprising a generally flat outer section disposed in a plane perpendicular to the axis of the piston means, the apex angle being about 160° to about 170°, the area of the angled section as viewed in said end view being greater than that of the generally flat section.

11. Apparatus as claimed in claim 10, wherein the area of said flat section is about 25 to 35% of the overall area of the frontal face.

12. Apparatus as claimed in claim 1, wherein a substantial part of that section of the conduit which is swept by a leading face of the reciprocating annular piston means as the piston means reciprocate, is a gas and liquid removal section provided with openings for communicating the conduit with ambient atmosphere, said apparatus further comprising cooling means operatively associated with a cooled section of said conduit, said cooled section of said conduit being disposed downstream of the gas and liquid removal section, but is spaced axially upstream from a discharge end of said conduit.

13. Apparatus as claimed in claim 12, wherein the cooled section is disposed upstream of a density sensing device which is located near the discharge end of said conduit.

14. Apparatus for feeding a mass of material comprised of solid particles and/or fibres, including a generally cylindric conduit provided with screw conveyor means, reciprocating annular piston means coaxial with and disposed around the screw conveyor means, first drive means for driving said screw conveyor means, and second drive means for driving the annular piston means in reciprocating fashion coaxially with the screw conveyor means, wherein a frontal face portion of the piston means, when viewed in an end view, covers an area whose size is about 35% to about 60% of the entire inside cross-sectional area of the conduit, said frontal face portion comprising a frustoconical angled surface coaxial with the axis of the piston means, convergent in a direction upstream of the conduit and having an apex angle of about 140° to about 170°.

15. Apparatus as claimed in claim 14, wherein the frustoconical angled surface is an inner frustoconical angled section, said frontal face portion further comprising a generally flat outer section disposed in a plane perpendicular to the axis of the piston means, the apex angle being about 160° to about 170°, the area of the angled section as viewed in said end view being greater than that of the generally flat section.

16. Apparatus as claimed in claim 14, wherein the area of said flat section is about 25 to about 35% of the overall cross-sectional area of the frontal face as viewed in said end view.

* * * * *